United States Patent [19]

Hirai et al.

[11] Patent Number: 4,622,289

[45] Date of Patent: Nov. 11, 1986

[54] HEAT-DEVELOPABLE LIGHT-SENSITIVE MATERIAL WITH BASE PRECURSOR

[75] Inventors: Hiroyuki Hirai; Kozo Sato, both of Kanagawa, Japan

[73] Assignee: Fuji Photo Film Co., Ltd., Kanagawa, Japan

[21] Appl. No.: 601,758

[22] Filed: Apr. 19, 1984

[30] Foreign Application Priority Data

Apr. 20, 1983 [JP] Japan ..... 58-69597

[51] Int. Cl.[4] ..... G03C 1/40; G03C 5/54

[52] U.S. Cl. ..... 430/559; 430/203; 430/351; 430/353; 430/677; 430/619; 430/955

[58] Field of Search ..... 430/203, 351, 353, 617, 430/619, 955, 559

[56] References Cited

U.S. PATENT DOCUMENTS

| | | | |
|---|---|---|---|
| 3,220,846 | 11/1965 | Tinker et al. | 430/617 |
| 3,645,739 | 2/1972 | Ohkubo et al. | 430/619 |
| 4,088,496 | 5/1978 | Merkel | 430/352 |

OTHER PUBLICATIONS

Sneeder, *The Chemistry of Carboxylic Acid and Esters,* Chapter 4, pp. 137–172, 1969.

Clark, *The Chemistry of Carboxylic Acid and Esters,* Chapter 12, pp. 589–622, 1969.

"Photothermographic Silver Halide Systems", Carpenter et al, *Research Disclosure,* No. 17029, 6/1978, pp. 9–15.

"Metal Salts in Photothermographic Materials", Derkersa et al, *Research Disclosure,* No. 12041, 4/1974, p. 35.

U.S. Application Ser. No. 767,405, Hirai et al.

*Primary Examiner*—Richard L. Schilling

*Attorney, Agent, or Firm*—Sughrue, Mion, Zinn Macpeak & Seas

[57] ABSTRACT

A heat-developable light-sensitive material is described, comprising a support and at least one layer containing an alkali metal and/or alkaline earth metal salt of a carboxylic acid as a base precursor.

21 Claims, No Drawings

HEAT-DEVELOPABLE LIGHT-SENSITIVE MATERIAL WITH BASE PRECURSOR

FIELD OF THE INVENTION

The present invention relates to a heat-developable light-sensitive material containing a base precursor.

BACKGROUND OF THE INVENTION

Heat-developable light-sensitive materials often contain a base or a base precursor for the purpose of accelerating heat development. For ensuring extended storage of the light-sensitive material, base precursors which release a basic material by thermal decomposition are particularly preferred.

Typical base precursors are described in British Pat. No. 998,949. A preferred base precursor is a salt of a carboxylic acid and an organic base. Useful carboxylic acid are trichloroacetic acid and trifluoroacetic acid, and useful bases are guanidine, piperidine, morpholine, p-toluidine and 2-picoline. The guanidine trichloroacetic acid as described in U.S. Pat. No. 3,220,846 is particularly useful. The aldoneamides as described in Japanese Patent Application (OPI) No. 22625/75 (the symbol OPI as used herein means an unexamined published Japanese patent application) generate bases by pyrolysis and are used advantageously.

However, many of these base precursors require a relatively long time to produce an image or are accompanied by high fog. Moreover, these base precursors are susceptible to be affected by air or moisture and are subsequently decomposed to change the photographic properties of the light-sensitive material or impair its storage stability. The present invention aims to overcome such defects.

SUMMARY OF THE INVENTION

One object of the present invention is to provide a heat-developable light-sensitive material which provides a high-density image within a short period of time.

Another object of the present invention is to provide a light-sensitive material containing a new base precursor which provides a high-density and low-fog image.

Still another object of the present invention is to provide a heat-developable light-sensitive material having improved long-term stability. The term "long-term stability" as used herein refers to minimizing changes in photographic properties of a heat-developable light-sensitive material, such as maximum density, minimum density, and sensitivity, during storage before heat development.

These objects of the present invention can be accomplished by a heat-developable light-sensitive material containing at least one salt selected from an alkali metal and alkaline earth metal salts of a carboxylic acid as a base precursor.

DETAILED DESCRIPTION OF THE INVENTION

A preferred base precursor is a carboxylic acid salt which is able to decarboxylate at a temperature between 80° C. and 250° C., and more preferably at a temperature between 100° C. and 200° C.

Preferred carboxylic acid salts which decarboxylate in the above-defined temperature range are represented by the formula:

$$\{R\text{-}(CO_2)_m\}_x M_n$$

wherein M is an alkali metal ion such as Na, K and Cs ions or an alkaline earth metal ion such as Ba and Ca ions; m and n are each an integer of 1 or 2; when M is an alkaline earth metal and m is 1, x is 2, and in other cases, x is 1; R is a substituted alkyl group having an electron attractive group at α-position and having preferably 1–12 carbon atoms, more preferably 1–6 carbon atoms; a substituted aryl group having an electron donative group at at least one of ortho- and para-positions and having preferably 6–12 carbon atoms, more preferably 6–9 carbon atoms; an alkynyl group having preferably 2–12 carbon atoms, more preferably 2–6 carbon atoms; a substituted alkynyl group having preferably 2–12 carbon atoms, more preferably 2–6 carbon atoms; an acyl group having preferably 2–12 carbon atoms, more preferably 2–6 carbon atoms in the case of an aliphatic acyl group, and having preferably 6–12 carbon atoms, more preferably 6–9 carbon atoms in the case of an aromatic acyl group; an alkoxycarbonyl group having preferably 2–12 carbon atoms, more preferably 2–6 carbon atoms; an aryloxycarbonyl group having preferably 7–12 carbon atoms, more preferably 7–9 carbon atoms; a carbamoyl group, a carbamoyl group substituted with at least one of, for example, an alkyl group having preferably 1–12 carbon atoms, more preferably 1–6 carbon atoms and an aryl group having preferably 6–12 carbon atoms, more preferably 6–9 carbon atoms; or a carbon ring or heterocyclic residual group of the formula:

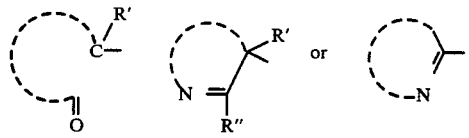

which forms a 5- or 6-membered ring; R' and R'' each represents a hydrogen atoms, an alkyl group having preferably 1–12 carbon atoms, more preferably 1–6 carbon atoms, a substituted alkyl group having preferably 1–12 carbon atoms, more preferably 1–6 carbon atoms, an aryl group having preferably 6–12 carbon atoms, more preferably 6–9 carbon atoms, and substituted aryl group having preferably 6–12 carbon atoms, more preferably 6–9 carbon atoms; provided that when m is 2, each of the groups listed above is divalent.

Preferred examples of R are listed below.

Illustrative substituted alkyl groups having an electron attractive group at the α-position are:

$CCl_3$—, $CBr_3$—, $CFCl_2$—, $CF_2Cl$—, $NCCH_2$—, $CH_3SO_2CH_2$—,

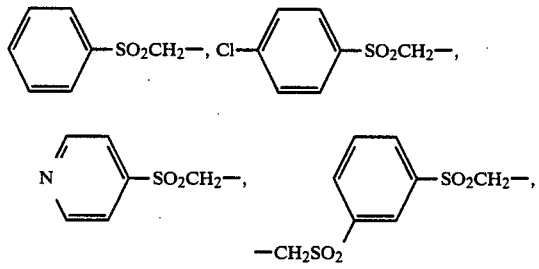

-continued
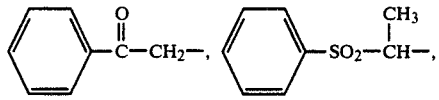
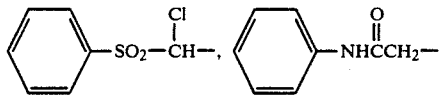
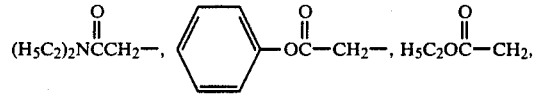
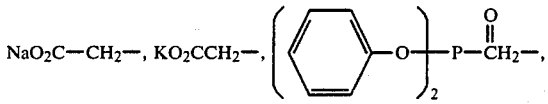
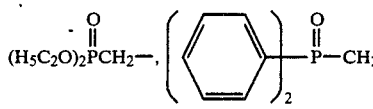
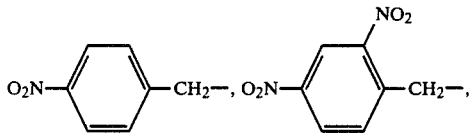
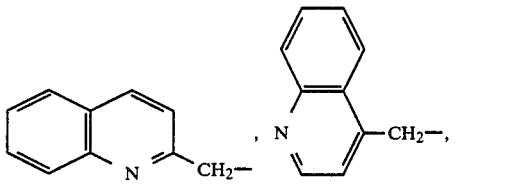
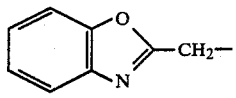
Illustrative substituted aryl groups having an electron donative group at ortho- and/or para-position are:
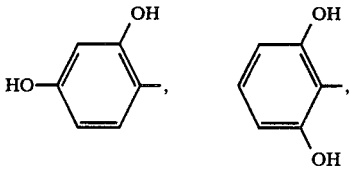
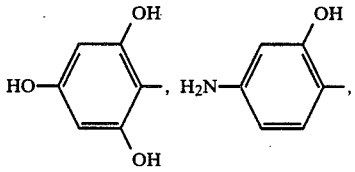
Illustrative substituted alkynyl groups are:
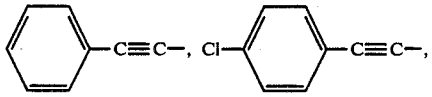
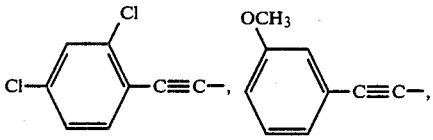
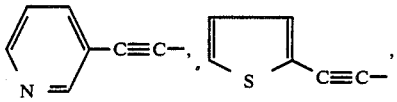
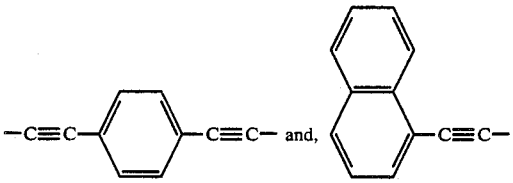
Illustrative acyl groups are:
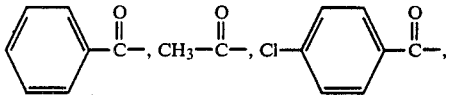
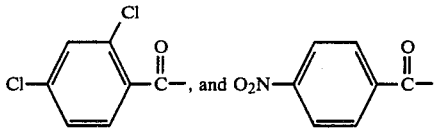
Illustrative alkoxycarbonyl groups are:
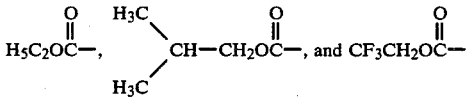
Illustrative aryloxycarbonyl groups are:
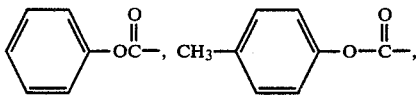
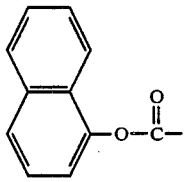
Illustrative substituted carbamoyl groups are:

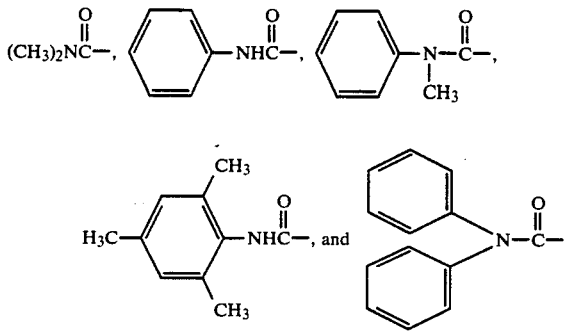

Preferred examples of

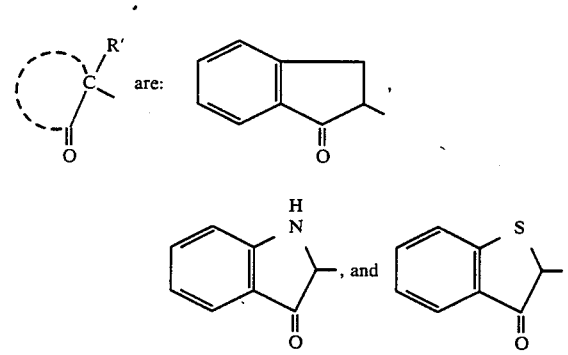

Preferred examples of

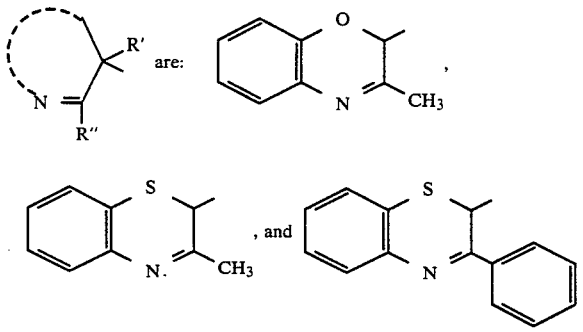

Preferred examples of

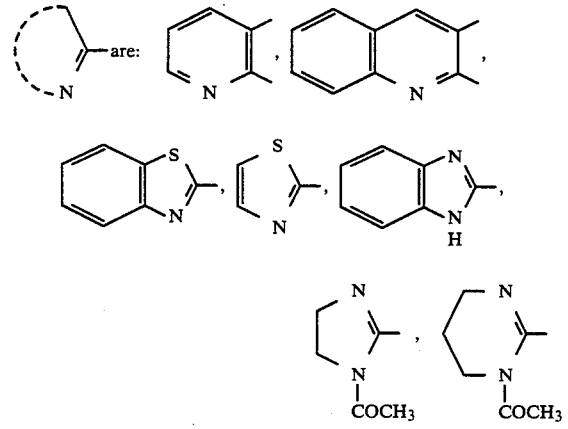

Preferred examples of M representing an alkali metal ion or an alkaline earth metal ion are $Na^+$, $K^+$, $Cs^+$, $Ca^{++}$ and $Ba^{++}$.

Specific examples of the preferred base precursor for use in the present invention are listed below.

(1) $CCl_3CO_2Na$, (2) $CFCl_2CO_2Na$, (3) $CFCl_2CO_2K$, (4) $CF_2Cl—CO_2Na$,

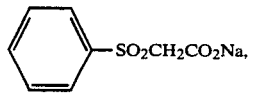

(5)

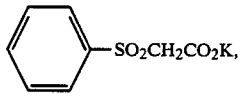

(6)

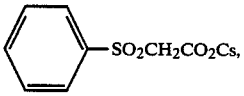

(7)

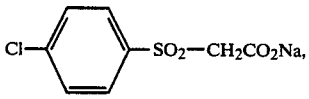

(8)

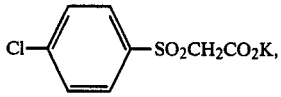

(9)

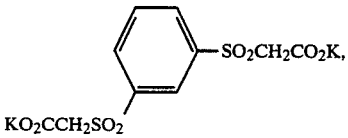

(10)

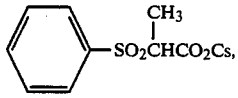

(11)

$CsO_2CCH_2CO_2Cs$, (12)

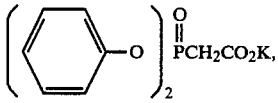

(13)

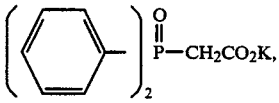

(14)

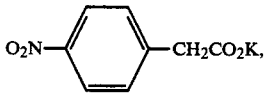

(15)

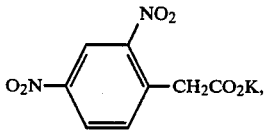

(16)

-continued
(17)
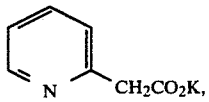
(18)
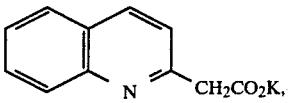
(19)
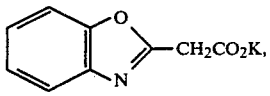
(20)
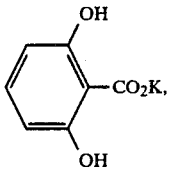
(21)
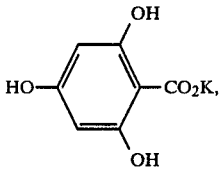
(22)
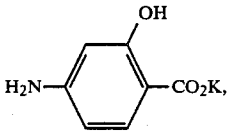
(23)
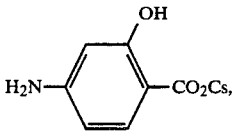
(24)
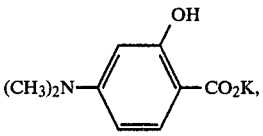
(25)
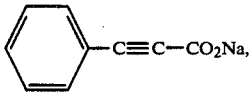
(26)
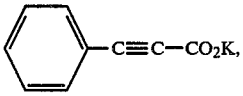
(27)
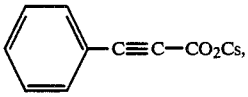
(28)
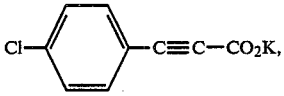
-continued
(29)
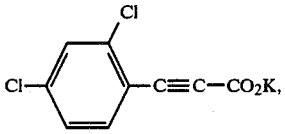
(30)
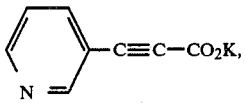
(31)
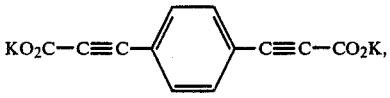
(32)
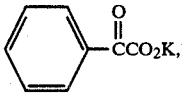
(33)
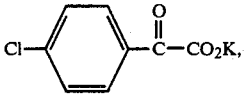
(34)
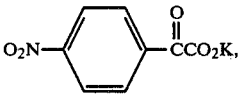
(35)
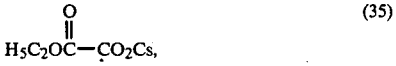
(36)
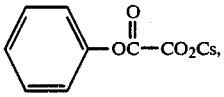
(37)
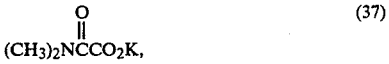
(38)
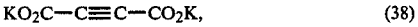
(39)
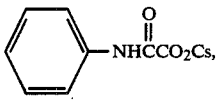
(40)
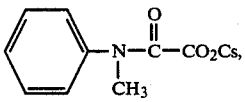
(41)
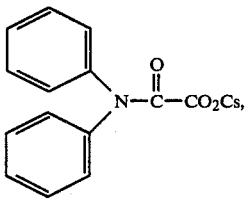
(42)
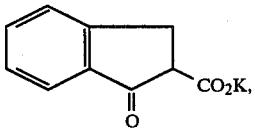

-continued (43)

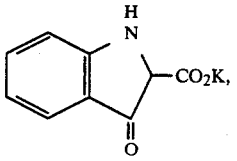

(44)

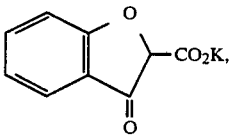

(45)

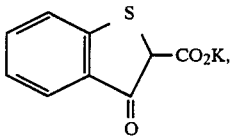

(46)

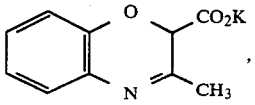

(47)

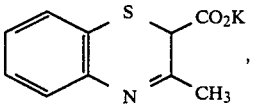

(48)

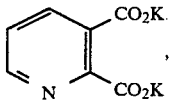

(49)

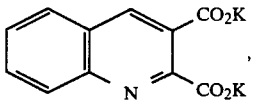

(50)

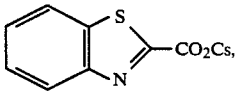

(51)

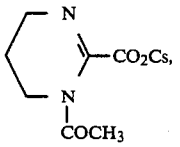

(52) $(CCl_3CO_2)_2Ba$,

(53) $(CFCl_2CO_2)_2Ba$, (54)

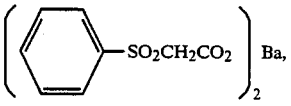

(55)

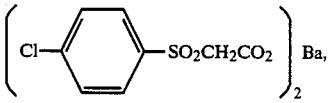

-continued (56)

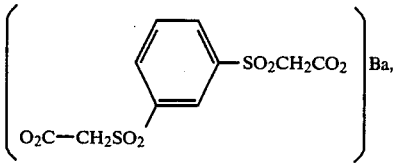

(57)

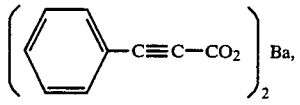

(58)

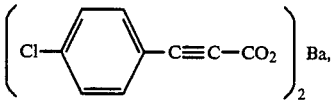

(59) $(O_2C-C\equiv C-CO_2)Ba$, (60)

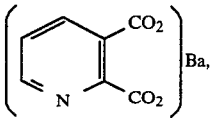

(61)

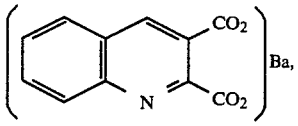

A base precursor for use in the present invention can be synthesized by a known method wherein a carboxylic acid prepared by a conventional method is neutralized with a corresponding base in water or an alcohol, thereby obtaining the intended base precursor either as a crystal or in solution.

The carboxylic acid used to form a base precursor which can subsequently be decarboxylated may be prepared by various known methods, depending on the specific type of the carboxylic acid. Typical methods are described below. For instance, if R is a substituted alkyl group having an electron attractive group at the α-position, α-halogenated acetic acid is reacted with a nucleophilic reagent such as a sulfinic acid salt or cyanide, or an active methyl or active methylene compound is reacted with a carbonate ester in the presence of a base. If R is a substituted aryl group having an electron donative group, carboxylation may be effected by the Kolbe-Schmidt reaction. If R is an alkynyl group, addition of bromine to an acrylic acid derivative and subsequent elimination of hydrogen bromide may be employed. For details of these reactions, see "New Course in Experimental Chemistry 14 (II)", 921–1062 (1977), Maruzen, and Organic Functional Group Preparations, 196–268 (1968), Academic Press. For starting materials of relatively simple structures, such as trihalogenated acetic acid, phenylacetic acid derivatives and α-ketocarboxylic acid, known commercial products are available and may be used as is.

The base precursors according to the present invention may be used either independently or in admixture with themselves or in combination with any or the dye release aids to be described herein.

The base precursor may be incorporated in any light-sensitive material so long as the heat development of the light-sensitive material is acceralated by the presence of a base compound.

Examples of light-sensitive material which can be used in the present invention include light-sensitive materials containing a silver salt such as a light-sensitive silver halide. In combination with a silver halide, the light-seisitive materials may further contain a leuco dye, dye forming compound such as a coupler or a dye-releasing compound.

The light-sensitive material of the present invention comprises a support and at least one light-sensitive layer provided thereon. The light-sensitive material may further have a subbing layer, an intermediate layer, protective layer, and an image-receiving layer.

The base precursor may be positioned in any part of the light-sensitive material e.g. intermediate layer, protective layer or emulsion layer so long as the precursor is able to act chemically on the light-sensitive substance upon heating so as to accelerate development. It is preferred, however, that the precursor is incorporated in a layer containing light-sensitive substance or a layer adjacent thereoto.

The base precursor according to the present invention may be used in an amount that varies over a wide range. Usually, the precursor is used in an amount not exceeding 50 wt% based on the total weight of the layer or layers coated on a surface of the support. A preferred range is from 0.01 to 40 wt%.

Heat-developable light-sensitive materials are known in the art, and their mechanism and methods of prossing are shown in many references, such as "Fundamentals of Photographic Engineering", pp. 553–555, Corona Publishing Company, 1979; "Video Information", p. 40, April 1978; Nebletts Handbook of Photography and Reprography", 7th ed., pp. 32–33, Van Nostrand Reinhold Company; U.S. Pat. Nos. 3,152,904, 3,301,678, 3,392,020, 3,457,075, British Pat. Nos. 1,131,108, 1,167,777; and Research Disclosure, June 1978, pp. 9–15 (RD-17029).

Many proposals have been made for producing color images by dry methods. Methods for forming a color image by the coupling of the oxidized product of a developing agent and a coupler are described in the following references: U.S. Pat. No. 3,531,286, which discloses the use of a p-phenylenediamine reducing agent and a phenolic or active methylene coupler; U.S. Pat. No. 3,761,270, which disclose the use of a p-aminophenol reducing agent; Belgian Pat. No. 802,519 and Research Disclosure, September 1975 (pp. 31–32), which disclose the use of a sulfonamidophenolic reducing agent; and U.S. Pat. No. 4,021,240 whcih proposes the use of a combination of sulfornamide phenolic reducing agent and a 4-equivalent coupler.

A method wherein a nitrogen-containing heterocyclic group is introduced into a dye, a silver salt is formed, and the dye is released upon thermal development is described in Research Disclosure, May 1978, pp. 54–58 (RD-16966).

A positive color image can be formed by thermal silver dye bleaching, and useful dyes and bleaching methods are shown in Research Disclosure, April 1976, pp. 30–32 (RD-14433), December 1976, pp. 14–15 (RD-15227), and U.S. Pat. No. 4,235,957.

Methods of using a leuco dye to form a color image are shown in U.S. Pat. Nos. 3,985,565 and 4,022,617.

The present invention may be applied to above-described conventional methods.

The advantages of the present invention are particularly great if it is used with image forming methods of the type shown in European Patent Application (OPI) Nos. 76492 and 79056, wherein a hydrophilic mobile dye pattern which is negative or positive to the silver image is formed by heating, and the so formed dye image is subsequently transferred to a dye fixing layer.

Therefore, it is particularly preferred that the base precursor according to the present invention be used in combination with one of the following dye releasing or forming materials, as well as with a silver halide and an organic silver salt, if desired.

(1) A dye releasing material capable of releasing a mobile dye upon reaction with the oxidized product of a reducing agent formed as a heat-initiated oxidation-reduction reaction with silver halide. An example of this compound is shown in European Patent Application (OPI) No. 79056. This compound is represented by the formula C-L-D, wherein D is an image-forming dye moiety, L is a linking group capable of cleavage from C when C reacts with the oxidized product of a reducng agent, and C is a substrate that binds with the oxidized product of a reducing agent; examples of C are groups having active methylene, active methine, phenolic residue or naphtholic residue. Preferred examples of C are represented by (A) to (G) as follows:

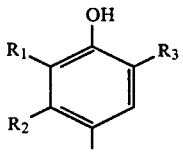

(A)

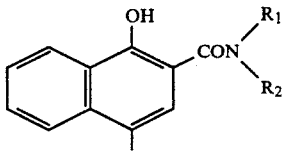

(B)

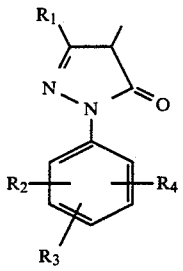

(C)

$R_1COCHCOR_2$
|
(D)

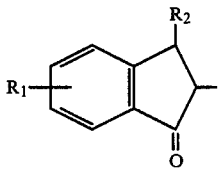

(E)

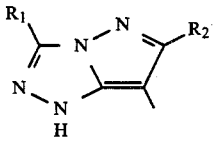

(F)

-continued

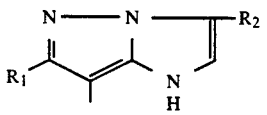

(G)

In the above formulae, $R_1$, $R_2$, $R_3$ and $R_4$ are each a substituent selected from a hydrogen atom, alkyl group, cycloalkyl group, aryl group, alkoxy group, aryloxy group, aralkyl group, acyl group, acylamino group, alkoxyalkyl group, aryloxyalkyl group, N-substituted carbamoyl group, alkylamino group, arylamino group, halogen atom, acyloxy group, acyloxyalkyl group and a cyano group. These substituents may be further substituted with a hydroxyl group, cyano group, nitro group, N-substituted sulfamoyl group, carbamoyl group, N-substituted carbamoyl group, acylamino group, alkylsulfonylamino group, arylsulfonylamino group, alkyl group, aryl group, alkoxy group, aryloxy group, aralkyl group or an acyl group.

The substrate C has the ability to release a mobile dye upon binding with the oxidized product of a reducing agent, and at the same time, the substrate must have a ballast group that prevents the dye releasing material form diffusing into a dye image-receiving layer. Preferred ballast groups are hydrophobic groups such as an alkyl group, alkoxyalkyl group and aryloxyalkyl group. These ballast groups desirably have a total of at least 6 carbon atoms, and the total number of carbon atoms in the substrate C is preferably 12 or more.

(2) A coupler capable of forming a mobile dye by coupling reaction with the oxidized product of a reducing agent formed by heat-initiated oxidation-reduction reaction with silver halide.

Examples of this coupler are shown in Japanese Patent Application (OPI) Nos. 149046/83 and 149047/83 and are characterized by having in a leaving group a non-diffusing group sufficient to prevent the diffusion of the coupler.

(3) A compound that releases a mobile dye upon heating but which no longer releases the mobile dye when it enters into the heat-initiated oxidation-reduction reaction with silver halide. Examples of such compound include the compounds described in U.S. Pat. No. 4,139,379 that initiate an intramolecular nucleophilic reaction, as well as the reduced products thereof.

(4) A dye releasing material having ability to reduce silver halide and which is capable of releasing a mobile dye by heat-initiated oxidation-reduction reaction with the silver halide. An example of this material is the compound shown in Japanese Patent Application (OPI) No. 58543/83 and has the following formula:

$$R_a—SO_2—D \quad (I)$$

wherein $R_a$ is a reducing substrate capable of being oxidized by silver halide and D is an image-forming dye moiety having a hydrophilic group.

The dye releasing or forming compound used in the present invention can be introduced into a layer of the light-sensitive material by known methods such as a method as described in U.S. Pat. No. 2,322,027. In this case, an organic solvent having a high boiling point or an organic solvent having a low boiling point as described below can be used. For example, the dye forming or releasing compound is dispersed in a hydrophilic colloid after being dissolved in an organic solvent having a high boiling point, for example, a phthalic acid alkyl ester (for example, dibutyl phthalate, dioctyl phthalate, etc.), a phosphoric acid ester (for example, diphenyl phosphate, triphenyl phosphate, tricresyl phosphate, dioctylbutyl phosphate, etc.), a citric acid ester (for example, tributyl acetylcitrate, etc.), a benzoic acid ester (for example, octyl benzoate, etc.), an alkylamide (for example, diethyl laurylamide, etc.), an aliphatic acid ester (for example, dibutoxyethyl succinate, dioctyl azelate, etc.), a trimesic acid ester (for example, tributyl trimesate, etc.), etc., or an organic solvent having a boiling point of about 30° C. to 160° C., for example, a lower alkyl acetate such as ethyl acetate, butyl acetate, etc., ethyl propionate, secondary butyl alcohol, methyl isobutyl ketone, β-ethoxyethyl acetate, methyl cellosolve acetate, cyclohexanone, etc. The above-described organic solvents having a high boiling point and organic solvents having a low boiling point may be used as a mixture thereof.

Further, it is possible to use a dispersion method using a polymer as described in Japanese Patent Publication No. 39853/76 and Japanese Patent Application (OPI) No. 59943/76. Moreover, various surface active agents can be used when the dye releasing redox compound is dispersed in a hydrophilic colloid. For this purpose, the surface active agents illustrated in other part of the specification can be used.

In the present invention, if desired a reducing agent may be used. The reducing agent in this case is the so-called auxiliary developing agent, which is oxidized by the silver halide and/or the organic silver salt oxidizing agent to form its oxidized product having an ability to oxidize the reducing group $R_a$ in the dye releasing redox compound.

Examples of useful auxiliary developing agents include the compounds specifically described in European Patent Application (OPI) No. 76,492.

The reducing agents that may be used in the present invention include the following compounds.

Hydroquinone compounds (for example, hydroquinone, 2,5-dichlorohydroquinone, 2-chlorohydroquinone, etc.), aminophenol compounds (for example, 4-aminophenol, N-methylaminophenol, 3-methyl-4-aminophenol, 3,5-dibromoaminophenol, etc.), catechol compounds (for example, catechol, 4-cyclohexylcatechol, 3-methoxycatechol, 4-(N-octadecylamino)catechol, etc.), phenylenediamine compounds (for example, N,N-diethyl-p-phenylenediamine, 3-methyl-N,N-diethyl-p-phenylenediamine, 3-methoxy-N-ethyl-N-ethoxy-p-phenylenediamine, N,N,N',N'-tetramethyl-p-phenylenediamine, etc.).

Various combinations of developing agents as described in U.S. Pat. No. 3,039,869 can also be used.

The amount of the reducing agent added is generally from 0.01 mol to 20 mols per mol of silver, and more preferably from 0.1 mol to 10 mols per mol of silver.

The silver halides that may be used in the present invention includes silver chloride, silver chlorobromide, silver chloroiodide, silver bromide, silver iodobromide, silver chloroiodobromide and silver iodide, etc.

In the embodiment of the present invention in which an organic silver salt oxidizing agent is not used together with the silver halide, but rather the silver halide is used alone, particularly preferred silver halide is silver halide partially containing a silver iodide crystal in its grain. That is, silver halide which shows by X-ray diffraction pattern the presence of pure silver iodide is particularly preferred.

A silver halide containing two or more kinds of halogen atoms can also be used. Such a silver halide is present in the form of a completely mixed crystal in a conventional silver halide emulsion. For example, the grain of silver iodobromide shows X-ray diffraction pattern at a position corresponding to the mixed ratio of silver iodide crystal and silver bromide crystal but not at positions corresponding to pure silver diodide crystal and pure silver bromide crystals separately.

Particularly preferred examples of silver halide used in the present invention include silver chloroiodide, silver iodobromide, and silver chloroiodobromide each containing silver iodide crystal in its grain and showing X-ray diffraction pattern of silver iodide crystal.

The process for preparing those silver halides is explained, for example, by taking the case of silver iodobromide. That is, the silver iodobromide is prepared by first adding silver nitrate solution to potassium bromide solution to form silver bromide particles and then adding potassium iodide to the mixture.

Two or more kinds of silver halides, in which the particle size and/or halogen composition are different from each other, may be used in mixture.

An average particle size of the silver halide used in the present invention is preferably from 0.001 μm to 10 μm and more preferably from 0.001 m to 5 μm.

The silver halide used in the present invention may be used as is. However, it may be chemically sensitized with a chemical sensitizing agent such as compounds or sulfur, selenium or tellurium, etc., or compounds of gold, platinum, palladium, rhodium or iridium, etc., a reducing agent such as tin halide, etc., or a combination thereof. The details thereof are described in T. H. James, *The Theory of the Photographic Process,* Fourth Edition, 1977, Chapter 5, pages 149 to 169.

In a particularly preferred embodiment of the present invention, an organic silver salt oxidizing agent is also used. The organic silver salt oxidizing agent is a silver salt which forms a silver image by reacting with the above-described image forming substance or a reducing agent that may be coexisting with the image forming substance, when it is heated to a temperature of above 80° C., and, preferably, above 100° C., in the presence of exposed silver halide. By use of the organic silver salt oxidizing agent together with the silver halide, light-sensitive material which provides higher color density can be obtained.

The silver halide used in this case is not always necessarily to have the characteristic in that the silver halide contains pure silver iodide crystal in the case of using the silver halide alone. Any silver halide which is known in the art can be used.

Examples of such organic silver salt oxidizing agents include those described in European Patent Application (OPI) No. 76,492.

A silver slat of an organic compound having a carboxyl group can be used. Typical examples thereof include a silver salt of an aliphatic carboxylic acid and a silver salt of an aromatic carboxylic acid.

In addition, a silver salt of a compound containing a mercapto group or a thione group and a derivative thereof can be used.

Further, a silver salt of a compound containing an imino group can be used. Examples of these compounds include a silver salt of benzotriazole and a derivative thereof as described in Japanese Patent Publication Nos. 30270/69 and 18416/70, for example, a silver salt of benzotriazole, a silver salt of alkyl substituted benzotriazole such as a silver salt of methylbenzotriazole, etc., a silver salt of a halogen substituted benzotriazole such as silver salt of 5-chlorobenzotriazole, etc., a silver salt of carboimidobenzotriazole such as a silver salt of butylcarboimidobenzotriazole, etc., a silver salt of 1,2,4-triazole or 1-H-tetrazole as described in U.S. Pat. No. 4,220,709, a silver salt of carbazole, a silver salt of saccharin, a silver salt of imidazole and an imidazole derivative, and the like.

Moreover, a silver salt as described in *Research Disclosure,* Vol. 170, No. 17029 (June, 1978) and an organic metal salt such as copper stearate, etc., are the organic metal salt oxidizing agent capable of being used in the present invention.

Methods of preparing these silver halide and organic silver salt oxidizing agents and methods of blending them are described e.g., in *Research Disclosure,* No. 17029, Japanese Patent Application (OPI) Nos. 32928/75 and 42529/76, U.S. Pat. No. 3,700,453, and Japanese Patent Application (OPI) Nos. 13224/74 and 17216/75.

A suitable coating amount of the light-sensitive silver halide and the organic silver salt oxidizing agent employed in the present invention is in a total of from 50 $mg/m^2$ to 10 $g/m^2$ calculated as an amount of silver.

The light-sensitive silver halide and the organic silver salt oxidizing agent used in the present invention are prepared in the binder as described below. Further, the dye releasing redox compound is dispersed in the binder described below.

The binders which can be used in the present invention can be employed individually or in a combination thereof. A hydrophilic binder can be used as the binder according to the present invention. The typical hydrophilic binder is a transparent or translucent hydrophilic colloid, examples of which include a natural substance, for example, protein such as gelatin, a gelatin derivative, etc., a cellulose derivative, a polysaccharide such as starch, gum arabic, etc., and a synthetic polymer, for example, a water-soluble polyvinyl compound such as polyvinyl alcohol, polyvinyl pyrrolidone, acrylamide polymer, etc. Another example of the synthetic polymer compound is a dispersed vinyl compound in a latex form which is used for the purpose of increasing dimensional stability of a photographic material.

The silver halide used in the present invention can be spectrally sensitized with methine dyes or other dyes. Suitable dyes which can be employed include cyanine dyes, merocyanine dyes, complex cyanine dyes, complex merocyanine dyes, holopolar cyanine dyes, hemicyanine dyes, styryl dyes, and hemioxonol dyes. Of these dyes, cyanine dyes, merocyanine dyes and complex merocyanine dyes are particularly useful. Any conventionally utilized nucleus for cyanine dyes, such as basic heterocyclic nuclei, can be contained in these dyes. That is, a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus, a pyridine nucleus, etc., and further, nuclei formed by condensing alicyclic hydrocarbon rings with these nuclei and nuclei formed by condensing aromatic hydrocarbon rings with these nuclei, that is, an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus, a quinoline nucleus, etc., are appropriate. The carbon atoms of these nuclei may also be substituted.

As nuclei having a ketomethylene structure, 5- or 6-membered heterocyclic nuclei such as a pyrazolin-5-one nucleus, a thiohydantoin nucleus, a 2-thiooxazolidin-2,4-dione nucleus, a thiazolidin-2,4-dione nucleus, a rhodanine nucleus, a thiobarbituric acid nucleus, etc., may also be used in merocyanine dyes and complex merocynine dyes.

These sensitizing dyes can be employed individually, and can also be employed in combination thereof. A combination of sensitizing dyes is often used, particularly for the purpose of supersensitization. Representative examples thereof are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862 and 4,026,707, British Pat. Nos. 1,344,281 and 1,507,803, Japanese Patent Publication Nos. 4936/68 and 12375/78, Japanese Patent Application (OPI) Nos. 110618/77 and 109925/77, etc.

The sensitizing dyes may be present in the emulsion together with dyes which themselves do not give rise to spectrally sensitizing effects but exhibit a supersensitizing effect or materials which do not substantially absorb visible light but exhibit a supersensitizing effect. For example, aminostilbene compounds substituted with a nitrogen-containing heterocyclic group (e.g., those described in U.S. Pat. Nos. 2,933,390 and 3,635,721), aromatic organic acid-formaldehyde condensates (e.g., those described in U.S. Pat. No. 3,743,510), cadmium salts, azaindene compounds, etc., can be present. The combinations described in U.S. Pat. Nos. 3,615,613, 3,615,641, 3,617,295 and 3,635,721 are particularly useful.

A support used in the light-sensitive material or used as the dye fixing material, if desired, according to the present invention is that which can endure at the processing temperature. As an ordinary support, not only glass, paper, metal or analogues thereto may be used, but also an acetyl cellulose film, a cellulose ester film, a polyvinyl acetal film, a polystyrene film, a polycarbonate film, a polyethylene terephthalate film, and a film related thereto or a plastic material may be used. Further, a paper support laminated with a polymer such as polyethylene, etc., can be used. The polyesters described in U.S. Pat. Nos. 3,634,089 and 3,725,070 are preferably used.

In the present invention, various kinds of dye releasing activators can be used. The dye releasing activator means a substance which accelerates the oxidation-reduction between the light-sensitive silver halide and/or the organic silver salt oxidizing agent and dye releasing redox compound, or accelerates release of a dye by means of its nucleophilic action to the oxidized dye releasing redox compound in the dye releasing reaction subsequently occurred, and a base and a base precursor other than the present invention can also be used. It is particularly advantageous to use these dye releasing activators in order to accelerate the reactions in the present invention.

Examples of preferred bases are amines which include trialkylamines, hydroxylamines, aliphatic polyamines, N-alkyl substituted aromatic amines, N-hydroxyalkyl substituted aromatic amines and bis{p-(dialkylamino)phenyl}methanes. Further, betaine tetramethylammonium iodide and diaminobutane dihydrochloride as described in U.S. Pat. No. 2,410,644, and urea and organic compounds including amino acids such as 6-aminocaproic acid as described in U.S. Pat. No. 3,506,444 are useful. The base precursor is a substance which releases a basic component by heating. Examples of typical base precursors are described in British Pat. No. 998,949. A preferred base precursor is a salt of a carboxylic acid and an organic base, and examples of the suitable carboxylic acids include trichloroacetic acid and trifluoroacetic acid and examples of the suitable bases include guanidine, piperidine, morpholine, p-toluidine and 2-picoline, etc. Guanidine trichloroacetate as described in U.S. Pat. No. 3,220,846 is particularly preferred. Further, aldonic amides as described in Japanese Patent Application (OPI) No. 22625/75 are preferably used because they decompose at a high temperature to form bases.

These dye releasing activators can be used in an amount of a broad range. A useful range is up to 50% by weight based on the amount of coated dry layer of the light-sensitive material. A range of 0.01% by weight to 40% by weight is more preferred.

It is advantageous to use a compound represented by the general formula described below in the heat-developable color photographic material in order to accelerate development and accelerate release of a dye.

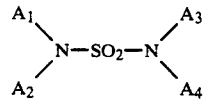

(A)

Wherein $A_1$, $A_2$, $A_3$ and $A_4$, which may be the same or different, each represents a hydrogen atom or a substituent selected from an alkyl group, a substituted alkyl group, a cycloalkyl group, an aralkyl group, an aryl group, a substituted aryl group and a heterocyclic group; and $A_1$ and $A_2$ and/or $A_3$ and $A_4$ may combine with each other to form a ring.

The above-described compound can be used in an amount of broad range. A useful range is up to 20% by weight based on the amount of coated dry layer of the light-sensitive material. A range of 0.1% by weight to 15% by weight is more preferred.

It is also advantageous to use a water releasing compound in the present invention in order to accelerate the dye releasing reaction.

The expression "water releasing compound" refers to a compound which releases water by decomposition during heat development. These compounds are particularly known in the field of printing of fabrics, and $NH_4Fe(SO_4)_2.12H_2O$, etc., as described in Japanese Patent Application (OPI) No. 88386/75 are useful.

Further, in the present invention, it is possible to use a compound which activates development and stabilizes the image at the same time. Particularly, it is preferred to use isothiuronium compounds including 2-hydroxyethylisothiuronium trichloroacetate as described in U.S. Pat. No. 3,301,678, bisisothiuroniums compounds including 1,8-(3,6-dioxaoctane)bis(isothiuronium trifluoroacetate), etc., as described in U.S. Pat. No. 3,669,670, thiol compounds as described in German Patent Application (OLS) No. 2,162,714, thiazolium compounds such as 2-amino-2-thiazolium trichloroacetate, 2-amino-5-bromoethyl-2-thiazolium trichloroacetate, etc., as described in U.S. Pat. No. 4,012,260; compounds having α-sulfonylacetate as an acid part, such as bis(2-amino-2-thiazolium)methylene-bis(sulfonylacetate), 2-amino-2-thiazolium phenylsulfonylacetate, etc., as described in U.S. Pat. No. 4,060,420, and compounds having 2-carboxycarboxamide as an acid part, as described in U.S. Pat. No. 4,088,496.

In the present invention it is possible to use a thermal solvent. The terminology "thermal solvent" refers to a non-hydrolyzable organic material which melts at a temperature of heat treatment, and melts at a lower temperature than that of the heat treatment when it is present together with other components. Preferred examples of thermal solvents include compounds which can act as a solvent for the developing agent and compounds having a high dielectric constant which accelerate physical development of silver salts. Examples of preferred thermal solvents include those described in European Patent Application (OPI) No. 76,492.

In the present invention, though it is not always necessary to further incorporate substances or dyes for preventing irradiation or halation in the light-sensitive material, because the light-sensitive material is colored by the dye releasing redox compound, it is possible to add filter dyes or light absorbing materials, etc., into the light-sensitive material, as described in Japanese Patent Publication No. 3692/73 and U.S. Pat. Nos. 3,253,921, 2,527,583 and 2,956,879, etc., in order to further improve sharpness. It is preferred that these dyes have a thermal bleaching property. For example, dyes as described in U.S. Pat. Nos. 3,769,019, 3,745,009 and 3,615,432 are preferred.

The light-sensitive material used in the present invention may contain, if necessary, various additives known for the heat-developable light-sensitive materials and may have a layer other than the light-sensitive layer, for example, an antistatic layer, an electrically conductive layer, a protective layer, an intermediate layer, an antihalation layer, a strippable layer, etc.

The photographic emulsion layer and other hydrophilic colloid layers in the light-sensitive material of the present invention may contain various surface active agents for various purposes, for example, as coating aids, or for prevention of electrically charging, improvement of lubricating property, emulsification, prevention of adhesion, improvement of photographic properties (for example, acceleration of development, rendering hard tone or sensitization), etc.

For example, it is possible to use nonionic surface active agents such as saponin (steroid saponin), alkylene oxide derivatives (for example, polyethylene glycol, polyethylene glycol/polypropylene glycol condensates, polyethylene glycol alkyl ethers or polyethylene glycol alkylaryl ethers, polyethylene glycol esters, polyethylene glycol sorbitan esters, polyalkylene glycol alkylamines or amides, polyethylene oxide adducts of silicone, etc.), glycidol derivatives (for example, alkenylsuccinic acid polyglycerides, alkylphenol polyglycerides, etc.), polyhydric alcohol aliphatic acid esters of saccharide alkyl esters, etc.; anionic surface active agents containing acid groups such as a carboxy group, a sulfo group, a phospho group, a sulfate group, a phosphate group, etc., such as alkylcarboxylic acid salts, alkylsulfonate salts, alkylbenzenesulfonate salts, alkylnaphthalenesulfonate salts, alkyl sulfuric acid esters, alkylphosphoric acid esters, N-acyl-N-alkyltaurines, sulfosuccinic acid esters, sulfoalkyl polyoxyethylene alkylphenyl ethers, polyoxyethylene alkylphosphoric acid esters, etc.; ampholytic surface active agents such as amino acids, aminoalkylsulfonic acids, aminoalkylsulfuric acid esters or phosphoric acid esters, alkylbetaines, amine oxides, etc.; and cationic surface active agents such as alkylamine salts, aliphatic or aromatic quaternary ammonium salts, heterocyclic quaternary ammonium salts such as pyridinium salts, imidazolium salts, etc., aliphatic or heterocyclic phosphonium salts, aliphatic or heterocyclic sulfonium salts, etc.

Of the above-described surface active agents, polyethylene glycol type nonionic surface active agents having a recurring unit of ethylene oxide in their molecules may be preferably incorporated into the light-sensitive material. It is particularly preferred that the molecule contains 5 or more of the recurring units of ethylene oxide.

The nonionic surface active agents capable of satisfying the above-described conditions are well known as to their structures, properties and methods of synthesis. These nonionic surface active agents are widely used in many fields. Representative references relating to these agents include: *Surfactant Science Series,* Vol. 1, Nonionic Surfactants (edited by Martin J. Schick, Marcel Dekker Inc., 1967), and *Surface Active Ethylene Oxide Adducts (edited by Schoufeldt N. Pergamon Press,* 1969). Among the nonionic surface active agents described in the above-mentioned references, those capable of satisfying the above-described conditions are preferably employed in connection with the present invention.

The nonionic surface active agents can be used individually or as a mixture of two or more thereof.

Polyethylene glycol type nonionic surface active agents can be used in an amount of less than 100% by weight, preferably less than 50% by weight, based on the weight of a hydrophilic binder.

The light-sensitive material of the present invention may contain a cationic compound containing a pyridinium salt. Examples of the cationic compounds containing a pyridinium group used are described in PSA Journal Section B 36 (1953), U.S. Pat. Nos. 2,648,604 and 3,671,247, Japanese Patent Publication Nos. 30074/69 and 9503/69, etc.

In the photographic light-sensitive material and the dye fixing material of the present invention, the photographic emulsion layer and other binder layers may contain inorganic or organic hardeners. It is possible to use chromium salts (chromium alum, chromium acetate, etc.), aldehydes (formaldehyde, glyoxal, glutaraldehyde, etc.), N-methylol compounds (dimethylolurea, methylol dimethylhydantoin, etc.), dioxane derivatives (2,3-dihydroxydioxane, etc.), active vinyl compounds (1,3,5-triacryloylhexahydro-s-triazine, 1,3-vinylsulfonyl-2-propanol, etc.), active halogen compounds (2,4-dichloro-6-hydroxy-s-triazine, etc.), mucohalogenic acids (mucochloric acid, mucophenoxychloric acid, etc.), etc., which are used individually or as a combination thereof.

Examples of various additives include those described in *Research Disclosure,* Vol. 170, No. 17029 (June, 1978), for example, plasticizers, dyes for improving sharpness, antihalation dyes, sensitizing dyes, matting agents, fluorescent whitening agents and fading preventing agents, etc.

If necessary, two or more layers may be coated at the same time by the method as described in U.S. Pat. No. 2,761,791 and British Pat. No. 837,095.

Various means for exposure can be used in the present invention. Latent images are obtained by imagewise exposure by radiant rays including visible rays. Generally, light sources used in this invention include tungsten lamps, mercury lamps, halogen lamps such as iodine lamps, xenon lamps, laser light sources, CRT light sources, fluorescent tubes and light-emitting diodes, etc.

In the present invention, after the heat-developable color photographic material is exposed to light, the resulting latent image can be developed by heating the whole material to a suitably elevated temperature, for example, about 80° C. to about 250° C. for about 0.5 second to about 300 seconds. A higher temperature or lower temperature can be utilized to prolong or shorten the heating time, if it is within the above-described temperature range. Particularly, a temperature range of about 110° C. to about 160° C. is useful.

As the heating means, a simple heat plate, iron, heat roller, heat generator utilizing carbon or titanium white, etc., or analogues thereof may be used.

In the present invention, a specific method for forming a color image by heat development comprises transfer of a hydrophilic mobile dye. For this purpose, the heat-developable color photographic material of the present invention is composed of a support having thereon a light-sensitive layer (I) containing at least silver halide, if desired, an organic silver salt oxidizing agent, a dye releasing redox compound which is also a reducing agent for the organic silver salt oxidizing agent and a binder, and a dye fixing layer (II) capable of receiving the hydrophilic diffusible dye formed in the light-sensitive layer (I).

The above-described light-sensitive layer (I) and the dye fixing layer (II) may be formed on the same support, or they may be formed on different supports, respectively. The dye fixing layer (II) can be stripped off the light-sensitive layer (I). For example, after the heat-developable color photographic material is exposed imagewise to light, it is developed by heating uniformly and thereafter the dye fixing layer (II) or the light-sensitive layer (I) is peeled apart. Also, when a light-sensitive material having the light-sensitive layer coated on a support and a fixing material having the dye fixing layer (II) coated on a support are separately formed, after the light-sensitive material is exposed imagewise to light and uniformly heated, the mobile dye can be transferred on the dye fixing layer (II) by superposing the fixing material on the light-sensitive layer.

Further, there is a method wherein only the light-sensitive layer (I) is exposed imagewise to light and heated uniformly by superposing the dye fixing layer (II) on the light-sensitive layer (I).

The dye fixing layer (II) can contain, for example, a dye mordant in order to fix the dye. In the present invention, various mordants can be used, and polymer mordants are particularly preferred. In addition to the mordants, the dye fixing layer may contain the bases, base precursors and thermal solvents. In particular, it is particularly preferred to incorporate the bases or base precursors into the dye fixing layer (II) in the cases wherein the light-sensitive layer (I) and the dye fixing layer are formed on different supports.

Preferred polymer mordants used in the present invention can be polymers containing secondary and tertiary amino groups, polymers containing nitrogen-containing heterocyclic moieties, polymers having quaternary cation groups thereof, having a molecular weight of from 5,000 to 200,000, and particularly from 10,000 to 50,000.

For example, vinylpyridine polymers and vinylpyridinium cation polymers as disclosed in U.S. Pat. Nos. 2,548,564, 2,484,430, 3,148,061, 3,756,814, etc., polymer mordants capable of cross-linking with gelatin as disclosed in U.S. Pat. Nos. 3,625,694, 3,859,096 and 4,128,538, British Pat. No. 1,277,453, etc., aqueous sol type mordants as disclosed in U.S. Pat. Nos. 3,958,995, 2,721,852 and 2,798,063, Japanese Patent Application (OPI) Nos. 115228/79, 145529/79 and 126027/79, etc., water-insoluble mordants as disclosed in U.S. Pat. No. 3,898,088, etc., reactive mordants capable of forming cobalent bonds with dyes used as disclosed in U.S. Pat. No. 4,168,976 (Japanese Patent Application (OPI) No. 137333/79), etc., and mordants disclosed in U.S. Pat. Nos. 3,709,690, 3,788,855, 3,642,482, 3,488,706, 3,557,066, 3,271,147 and 3,271,148, Japanese Patent Application (OPI) Nos. 71332/75, 30328/78, 155528/77, 125/78 and 1024/78, etc., can be illustrated.

In addition, mordants disclosed in U.S. Pat. Nos. 2,675,316 and 2,882,156 can be used.

The dye fixing layer (II) can have a white reflective layer. For example, a layer of titanium dioxide dispersed in gelatin can be provided on the mordant layer on a transparent support. The layer of titanium dioxide forms a white opaque layer, by which reflection color images of the transferred color images which can be observed through the transparent support is obtained.

Typical dye fixing material used in the present invention is obtained by mixing the polymer containing ammonium salt groups with gelatin and applying the mixture to a transparent support.

The transfer of dyes from the light-sensitive layer to the dye fixing layer can be carried out using a dye transfer assistant.

In the process in which the dye transfer assistants are supplied from the outside, water and an aqueous solution containing sodium hydroxide, potassium hydroxide or an inorganic alkali metal salt can be used. Further, a solvent having a low boiling point such as methanol, N,N-dimethylformamide, acetone, diisobutyl ketone, etc., and a mixture of such a solvent having a low boiling point with water or an alkaline aqueous solution can be used. The dye transfer assistant may be applied by wetting the dye fixing layer with the transfer assistant.

When the dye transfer assistant is incorporated into the light-sensitive material or the dye fixing material, it is not necessary to supply the transfer assistant from the outside. In this case, the above-described dye transfer assistant may be incorporated into the material in the form of water of crystallization or microcapsules or as a precursor which releases a solvent at a high temperature.

More preferred is a process wherein a hydrophilic thermal solvent which is solid at a lower temperature and melts at a higher temperature is incorporated into the light-sensitive material or the dye fixing material. The hydrophilic thermal solvent can be incorporated either into any of the light-sensitive material and the dye fixing material or into both of them. Although the solvent can be incorporated into any of the emulsion layer, the intermediate layer, the protective layer and the dye fixing layer, it is preferred to incorporate it into the dye fixing layer and/or adjacent layers thereto.

Examples of the hydrophilic thermal solvents include ureas, pyridines, amides, sulfonamides, imides, alcohols, oximes and other heterocyclic compounds.

EXAMPLE 1

Preparation of Silver Iodobromide Emulsion

Gelatin (40 g) and KBr (26 g) were dissolved in water (3000 ml). The solution was agitated at 50° C. Silver nitrate (34 g) was dissolved in water (200 ml), and the resulting solution was added to the KBr solution over a period of 10 minutes. To this solution, a solution of KI (3.3 g) in water (100 ml) was added over a period of 2 minutes. The pH of thus preparated silver iodobromide emulsion was adjusted to precipitate the emulsion and the excess salt was then filtered out. The pH of the emulsion was adjusted to 6.0 to obtain a silver iodobromide emulsion (yield: 400 g).

Preparation of Coupler Dispersion in Gelatin 2-dodecylcarbomyl-1-naphthol (5 g), succinic acid-2-ethylhexyl ester sodium sulfonate (0.5 g) and tricresyl phosphate (TCP) (2.5 g) were dissolved in ethyl acetate (30 ml). The resulting solution was mixed with a 10% wt% gelatin solution (100 g) under agitation, and the mixture was homogenized for 10 minutes at 10,000 rpm to obtain a uniform dispersion.

A coating liquid having the composition indicated below was applied to a polyethylene terephthalate film base to give a wet thickness of 60 μm and dried to prepare a light-sensitive material.

| | | |
|---|---|---|
| (a) | Silver iodobromide emulsion | 10 g |
| (b) | Coupler dispersion in gelatin | 3.5 g |
| (c) | Solution of base precursor (8) of the present invention dissolved in 2.5 ml of water (precursor) | 0.25 g |
| (d) | Gelatin (10 wt % aq. sol.) | 5 g |
| (e) | Solution of 2,6-dichloro-p-aminophenol dissolved in 15 ml of water | 0.2 g |

The light-sensitive material thus prepared was imagewise exposed using a tungsten lamp (2,000 1x, 5 sec). Then, the exposed material was heated uniformly on a heat block (150° C., 20 sec) to provide a negative cyan dye. The image density was measured with a Macbeth transmission densitometer: Dmin was 0.26 and Dmax was 2.05.

The above result indicates that the base precursor according to the present invention gives a high density.

EXAMPLE 2

In this example, a silver iodobromide emulsion of the same type as used in Example 1, and a dispersion of dye releasing material prepared as follows were used.

Preparation of Dispersion of Dye Releasing Material

Five grams of a dye releasing material having the formula indicated below:

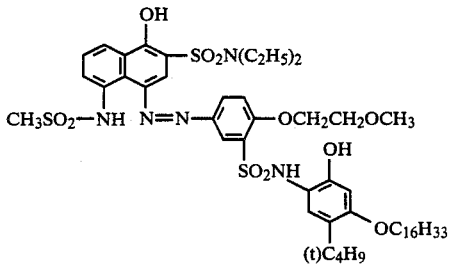

and 0.5 g of surfactant i.e. succinic acid-2-ethylhexyl ester sodium sulfonate and 5 g of tricresyl phosphate (TCP) were dissolved in 30 ml of ethyl acetate under heating at about 60° C. The resulting solution was mixed with a 10 wt% gelatin solution (100 g) under agitation, and the resulting mixture was homogenized for 10 minutes at 10,000 rpm to form a uniform dispersion.

A coating composition was prepared from the following formulation.

| | | |
|---|---|---|
| (a) | Light-sensitive silver iodobromide emulsion (as shown in Example 1) | 25 g |
| (b) | Dispersion of dye releasing material | 33 g |
| (c) | 5 wt % Aqueous solution of the following compound: 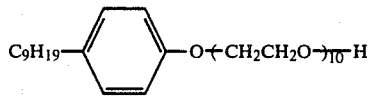  | 10 ml |
| (d) | 10 wt % Aqueous solution of the following compound: $H_2NSO_2N(CH_3)_2$ | 4 ml |
| (e) | Solution of base precursor (8) of the present invention dissolved in 20 ml of water (precursor) | 2 g |

The above components of (a)–(e) were mixed and dissolved under heating. The resulting solution was applied onto a polyethylene terephthalate film base to give a wet thickness of 30 μm and dried to provide a light-sensitive material. This material was imagewise exposed using a tungsten lamp (2000 1x, 10 sec) and heated uniformly on a heat block (150° C., 30 sec) to provide sample A.

A light-sensitive material was prepared as above except that component (e) according to the present invention was replaced by 20 ml of a 5% aqueous solution of sodium hydrogencarbonate. The material was subsequently processed as above to provide sample B.

Preparation of Image-receiving Material

Ten grams of methyl acrylate-N,N,N-trimethyl-N-vinyl-benzylammonium chloride copolymer (molar ratio of methyl acrylate to vinyl benzyl ammonium chloride is 1:1) was dissolved in water (200 ml), and the solution was mixed uniformly with 10 wt% lime-treated gelatin (100 g). The resulting mixture was uniformly spread onto a paper base laminated with $TiO_2$ dispersed polyethylene, thereby forming an image-receiving layer of a uniform wet thickness of 90 μm. The layer was dried to provide an image-receiving material. Two samples of this image-receiving material were prepared.

The two samples were dipped in water and recovered therefrom. Samples A and B of the light-sensitive material are superimposed on each sample of image-receiving material in such a manner that each of the light-sensitive layer was in contact with the image-receiving layer, respectively.

After heating on a heat block (80° C.) for 6 seconds, the two samples of the image-receiving material were peeled from the respective samples of light-sensitive material. A negative magenta image was formed on each sample of the image-receiving material. The density of each negative image was measured with a Macbeth reflection densitometer. The results were as follows.

| Sample No. | Dmax | Dmin |
|---|---|---|
| A | 2.15 | 0.23 |
| B (control) | 2.21 | 0.62 |

The above results show that the base precursor according to the present invention gives high maximum and low minimum densities.

Samples A and B were left to stand at 60° C. for 2 days, and heat developed as above. The Dmin and Dmax of the image of sample A were 0.28 and 2.16, respectively, but fog occurred throughout the surface of sample B. Thus, the sample using the base precursor according to the present invention has an improved storage stability.

EXAMPLE 3

The procedure of Example 2 was repeated except that the base precursors shown in the following table were used. The results are also shown in the same table.

| Sample No. | Base Precursor (g) | | Dmax |
|---|---|---|---|
| C | Compound (1) | 2.0 | 2.09 |
| D | Compound (7) | 2.3 | 2.03 |
| E | Compound (9) | 2.3 | 2.11 |
| F | Compound (25) | 1.8 | 2.13 |
| G | Compound (29) | 2.5 | 2.19 |
| H | Compound (34) | 2.3 | 1.73 |
| I | Compound (48) | 2.5 | 1.77 |
| J | Compound (52) | 3.0 | 1.62 |
| K | Compound (57) | 2.5 | 1.60 |

The above results show that base precursors according to the present invention give high maximum densities.

EXAMPLE 4

In this example, an organic silver salt oxidizing agent was used.

Preparation of Silver Benzotriazole Emulsion

Gelatin (28 g) and benzotriazole (13.2 g) were dissolved in water (3000 ml). The resulting solution was agitated at 40° C. To this solution, a solution having silver nitrate (27 g) dissolved in water (100 ml) was added over a period of 2 minutes.

The resulting benzotriazole silver emulsion was pH-adjusted to precipitate, and the excess salt was filtered out. The emulsion was adjusted to a pH of 6.0, thereby providing a silver benzotriazole emulsion (yield: 400 g).

Using this silver benzotriazole emulsion, a coating composition was prepared from the following formulation.

| | | |
|---|---|---|
| (a) | Silver iodobromide emulsion (as prepared in Example 1) | 20 g |
| (b) | Silver benzotriazole emulsion | 10 g |
| (c) | Dispersion of dye releasing material (as prepared in Example 2) | 33 g |
| (d) | 5% Aqueous solution of the following compound: 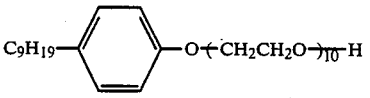 | 10 ml |
| (e) | 10% Aqueous solution of the following compound: $H_2NSO_2N(CH_3)_2$ | 4 ml |
| (f) | Solution of base precursor (8) of the present invention dissolved in 20 ml of water (precursor) | 2 g |

The above components of (a)–(f) were mixed and subsequently a sample was prepared and processed in the same manner as Example 2. The results are shown in the following table, which also shows the result with a control sample.

| Sample | Dmax | Dmin |
|---|---|---|
| Containing base precursor (8) of the present invention | 2.32 | 0.25 |
| Containing sodium hydrogencarbonate (control) | 2.39 | 0.87 |

The base precursor according to the present invention gives high maximum and low minimum densities.

EXAMPLE 5

Preparation of Silver Benzotriazole Emulsion Containing Light-sensitive Silver Bromide Benzotriazole (6.5 g) and gelatin (10 g) were dissolved in water (1000 ml). The resulting solution was agitated at 50° C. To this solution, a solution having silver nitrate (8.5 g) dissolved in water (100 ml) was added over a period of 2 minutes.

Then, a solution having potassium bromide (1.2 g) dissolved in water (50 ml) was added over a period of 2 minutes. The thus prepared emulsion was pH-adjusted to precipitate, and the excess salt was filtered out. The emulsion was adjusted to a pH of 6.0, thereby providing a silver benzotriazole emulsion (yield: 200 g).

Preparation of Gelatin Dispersion of Dye Releasing Material

Ten grams of a dye releasing material of the following formula:

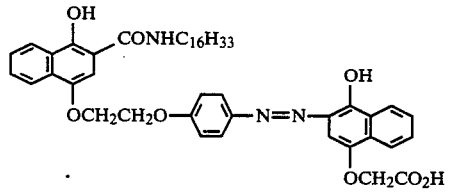

and 0.5 g of a surfactant i.e. succinic acid-2-ethylhexyl ester sodium sulfate, and 4 g of tricresyl phosphate (TCP) were dissolved in 20 ml of cyclohexanone under heating at about 60° C., thereby producing a uniform solution. This solution was mixed with a 10 wt% solution of lime-treated gelatin (100 g) under agitation, and the mixture was homogenized for 10 minutes at 10,000 rpm, thereby producing a uniform dispersion.

A coating composition for light-sensitive material was prepared from the following formulation.

| | | |
|---|---|---|
| (a) | Silver benzotriazole emulsion containing light-sensitive silver bromide | 10 g |
| (b) | Dispersion of dye releasing material | 3.5 g |
| (c) | Solution having base precursor (8) of the present invention dissolved in 2.5 cc of water (precursor) | 0.25 g |

ing a mobile dye by heat-initiated oxidation-reduction reaction with the silver halide.

10. A heat developable light-sensitive material as in claim 2, wherein R is a substituted alkyl group having an electron attractive group at the $\alpha$-position is a group selected from the group consisting of $CCl_3$—, $CBr_3$—, $CFCl_2$—, $NCCH_2$—, $CF_2Cl$—, $CH_3SO_2CH_2$—.

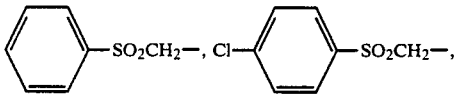

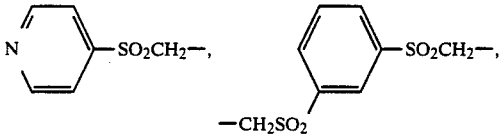

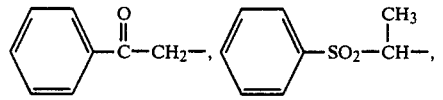

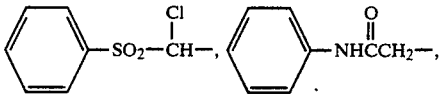

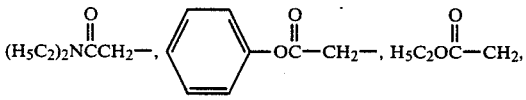

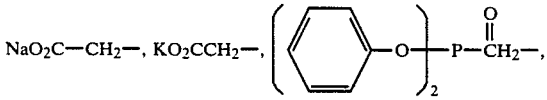

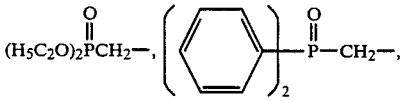

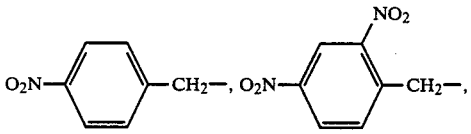

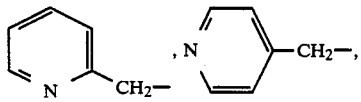

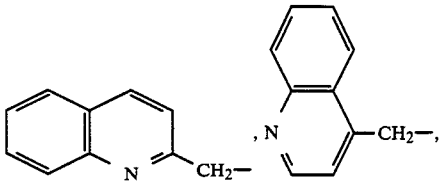

-continued

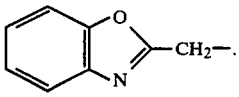

11. A heat developable light-sensitive material as in claim 2, wherein R is a substituted aryl group having an electron donative group at at least one of the ortho- and para-positions is a group selected from the group consisting of

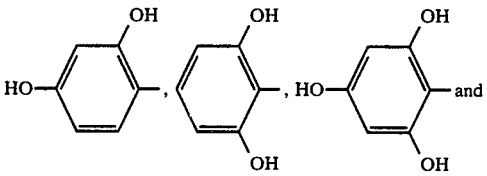

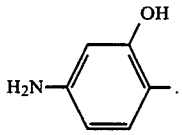

12. A heat developable light-sensitive material as in claim 2, wherein R is an alkynyl group selected from the group consisting of

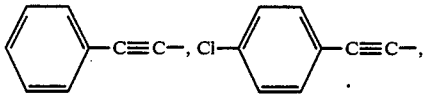

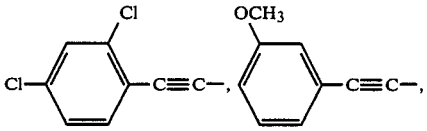

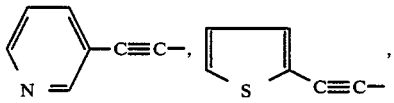

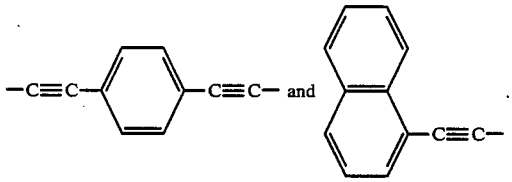

13. A heat developable light-sensitive material as in claim 2, wherein said acyl group is selected from the group consisting of

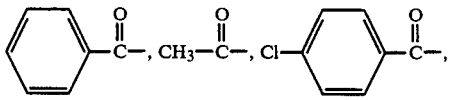

-continued

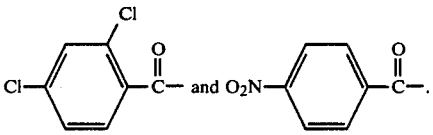

14. A heat developable light-sensitive material as in claim 2, wherein said alkoxycarbonyl group is selected from the group consisting of

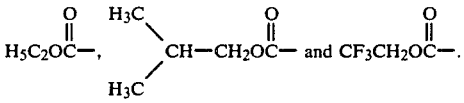

15. A heat developable light-sensitive material as in claim 2, wherein said aryloxycarbonyl group is selected from the group consisting of

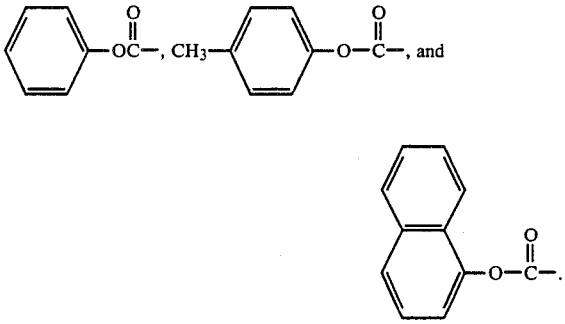

16. A heat developable light-sensitive material as in claim 2, wherein said substituted carbamoyl group is selected from the group consisting of

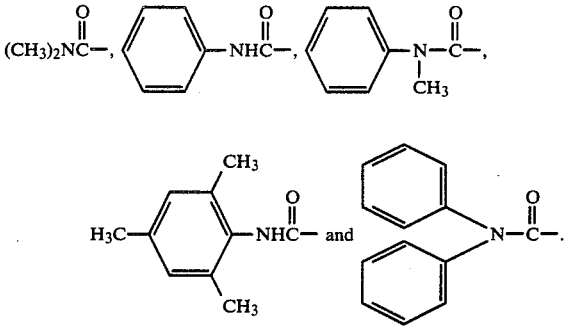

17. A heat developable light-sensitive material as in claim 2, wherein the group represented by the formula

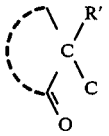

is a group selected from the group consisting of

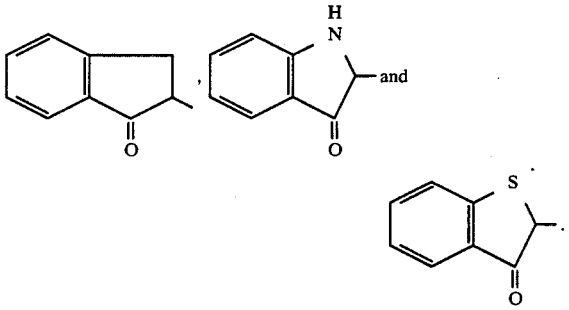

18. A heat developable light-sensitive material as in claim 2, wherein the group represented by the formula

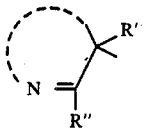

is a group selected from the group consisting of

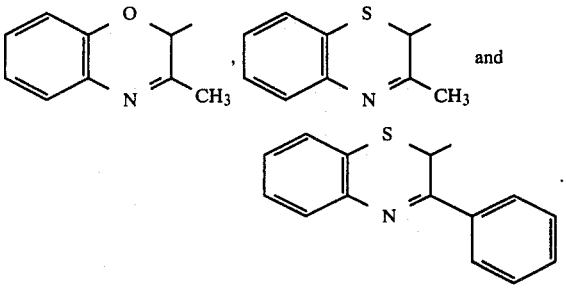

19. A heat developable light-sensitive material as in claim 2, wherein the group represented by the formula

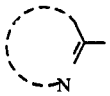

is a group selected from the group consisting of

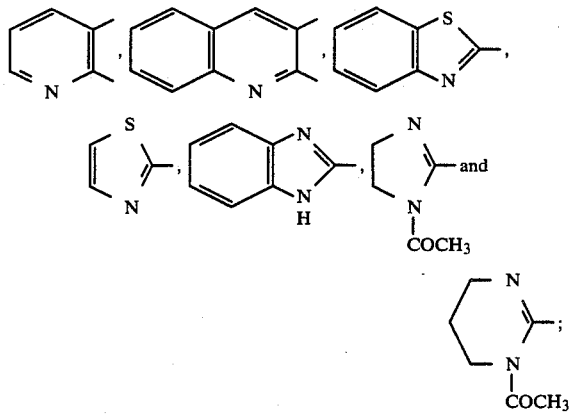

20. A heat-developable light-sensitive material as claimed in claim 1, wherein the base precursor decarboxylates at a temperature between 100° C. and 200° C.

21. A heat-developable light-sensitive material as in claim 1, wherein the base precursor decarboxylates at a temperature between 80° C. and 160° C.

* * * * *